US007897204B2

(12) United States Patent
Usherenko

(10) Patent No.: US 7,897,204 B2
(45) Date of Patent: Mar. 1, 2011

(54) METHOD OF STRENGTHENING TOOL MATERIAL BY PENETRATION OF REINFORCING PARTICLES

(75) Inventor: Sergey Usherenko, Haifa (IL)

(73) Assignees: Nanotech Industries, Inc., Daly City, CA (US); Polymate, Ltd., Migdal Ha'emeq (IL)

( * ) Notice: Subject to any disclaimer, the term of this patent is extended or adjusted under 35 U.S.C. 154(b) by 157 days.

(21) Appl. No.: 12/322,003

(22) Filed: Jan. 29, 2009

(65) Prior Publication Data

US 2010/0189891 A1 Jul. 29, 2010

(51) Int. Cl.
*B05D 1/12* (2006.01)

(52) U.S. Cl. ..... 427/201; 427/180; 427/190

(58) Field of Classification Search ..... 427/180, 427/190, 201

See application file for complete search history.

(56) References Cited

U.S. PATENT DOCUMENTS

| | | | | |
|---|---|---|---|---|
| 3,473,943 | A * | 10/1969 | Tsunetoshi | 427/189 |
| 4,004,735 | A * | 1/1977 | Zverev et al. | 239/79 |
| 4,295,896 | A | 10/1981 | Flemings et al. | |
| 5,330,790 | A * | 7/1994 | Calkins | 427/204 |
| 5,382,116 | A | 1/1995 | Nakanishi | |
| 2004/0164058 | A1 | 8/2004 | Sanders et al. | |
| 2005/0153069 | A1 * | 7/2005 | Tapphorn et al. | 427/180 |
| 2007/0084263 | A1 | 4/2007 | Zurecki | |

FOREIGN PATENT DOCUMENTS

| | | |
|---|---|---|
| SU | 703585 | 12/1979 |
| SU | 800235 | 1/1981 |

OTHER PUBLICATIONS

Physical Review Letters, 96, 195701 (May 19, 2006) by U. A. Glasmacher et al.

Nanocomposite Tool Steels-Proc. Composites, Nano Engineering (ICCE 15), Haikou, Hainan Island, China, Hawaii of the Orient, Jul. 15-21, 2007, p. 227-228, by O. Figovsky, et al.

Journal "Scientific Israel—Technological Advantages", vol. 8, No. 1,2 ( Special Issue), 2006, pp. 83-94, by Sergey Usherenko.

* cited by examiner

*Primary Examiner*—Frederick J Parker

(74) *Attorney, Agent, or Firm*—Haynes and Boone, LLP; Pavel I. Pogodin

(57) ABSTRACT

A method of strengthening the matrix of a high-speed steel for forming a composite tool material by super-deep penetration of reinforcing particles into and through the matrix of the tool material. The particles interact with the matrix in the form of a high-speed jet generated and energized by an explosion of an explosive material that contains the premixed powdered components of the working medium composed of particles of a hard material and ductile metal, and if necessary, with an addition of a process liquid. The particles of the working medium material have dimensions ranging from 1 to 100 μm. The jet has a pulsating nature with the velocity in the range of 200 to 600 m/sec and a temperature in the range 100 to 2000° C. As a result of strengthening, the steel matrix is reinforced by elongated zones of the working material particles which are oriented in the direction of the jet and occupy less than 1 vol. % of the matrix material, while less than 10 vol. % is occupied by the zones of the matrix restructured as a result of interaction with the particles of the super-high velocity jet.

28 Claims, 2 Drawing Sheets

METHOD OF STRENGTHENING TOOL MATERIAL BY PENETRATION OF REINFORCING PARTICLES

FIELD OF THE INVENTION

The invention relates to the process of manufacturing composite materials based on a matrix of a tool material, in particular, high-speed steel (HSS) intended for production of cutting tools used in metal cutting and mining industries. More specifically, the invention relates to a method of strengthening a material, in particular, high-speed steel by penetration of ceramic and other hard particles to a significant depth and even through the entire matrix of the treated material. In particular, the invention concerns a method of strengthening an HSS billets for converting this billet into a massive composite material suitable for manufacturing cutting-tool inserts.

BACKGROUND OF THE INVENTION

Generally, the use of tungsten carbide (WC) or cobalt (Co) alloys as materials for the cutting inserts of cutting tools employed in the mining industry is limited by physical properties of the tool per se as well as by relatively low resistance of the WC—Co-based cutting inserts to impacts and flexural loads. Moreover, in Europe WC and Co alloys are regarded as carcinogenic materials unsuitable for production and use. In many cases, the use of tool materials strengthened by reinforcing coatings depends on operating conditions. For example, in the mining industry, coating-reinforced cutting tool inserts cannot be efficiently used because the need for frequent change of such inserts significantly decreases efficiency of the cutting process and mining and impair operating conditions for workers. For the last 70 years, cutting tools have been equipped with cutting inserts made predominantly from WC—Co alloys, which have low resistance to dynamic loads and are ecologically hazardous.

On the other hand, the performance characteristics and operating conditions of cutting tool inserts may to a great extent depend on the type of the material and the condition of the cutting-tool holders into which the cutting inserts are incorporated. For example, there is a great difference in wear-resistant properties between the material of a cutting-insert holder and the material of a cutting-tool insert because the material of the insert is "washed out" from the steel holder. This, in turn, increases the protruding length of the insert and, eventually, leads to insert breakage under the effect of flexural loads and impacts.

Furthermore, the rapid cooling of cutting tools for the purpose of creating better operating conditions and for increasing cutting efficiency develops a network of cracks in the material of the hard alloy. These cracks lead to cutting-tool breakage and to an increase in dynamic load on the equipment. Contact with products of cutting-chip breakage is hazardous to the health of working personnel and therefore demands additional safety measures. All of this further contributes to the increase in final production.

Physical and mechanical properties of known tool materials limit the design possibilities for development of new design tools and for saving energy consumed by cutting and mining processes.

U.S. Pat. No. 5,382,116 issued in 1995 to Nakanishi discloses a ground-reforming method with a hardening material mixed and injected at super-high pressure. The method provides strengthening of the metal by subjecting it to intensive cooling under high pressure. This method, however, is not suitable for strengthening tool steel by converting it into a massive homogenously strengthened composite material (hereinafter referred as "massive composite material") and therefore does not allow use of all advantages inherent in composite materials of high strength.

U.S. Patent Application Publication No. 20070084263 published in 2007 (inventor: Zurecki) discloses changes in the material of a billet by impinging the material with a jet of a cryogenic liquid. Such treatment efficiently cools the surface of the material and provides hardening. However, the method does not ensure deep penetration of the jet into the body of the ingot and therefore is not suitable for production of a massive composite material for use in tool manufacturing.

U.S. Patent Application Publication No. 20040164058 published in 2004 (inventors: Sanders, et al) describes a method for changing the material structure by acting onto the surface of the material with a steam of solid particles. In accordance with the method, a molten material is applied to the surface of the tool through a nozzle. Use of electrical energy to melt the material and to accelerate the stream modifies the surface of the material being treated. However, in spite of the high level of energy of the stream, the method does not cause changes in the entire volume of the steel billet and cannot be used to produce massive composite materials suitable for the tool-manufacturing industry.

U.S. Pat. No. 4,295,896 issued to Flemings, et al, in 1981 discloses metal compositions having significantly improved mechanical properties and substantially free of second-phase material. The method does allow production of massive composite materials under static conditions. The original material that represents a multiphase system is heated to a temperature higher than the unbalanced temperature of the Solidus curve, and the liquid-solid mixture is subjected to high pressure that extrudes the liquid through the filter. Simultaneously, high pressure is applied to the solid body to keep the diluted materials in a solid state and to provide for preservation of the secondary phase of the material. After removal of the inter-dendrite liquid, the steel structure is preserved by means of rapid cooling of the alloy. However, this is an energy-consuming process resulting in low productivity. The structure of the composite produced according to the above method does impart improve dynamic properties to the obtained material.

A method for processing the surface of a polymeric item by impact penetration (implantation) of macro particles to improve strength, friction resistance, and other surface properties is described in U.S. Pat. No. 5,330,790 issued to Calkins in 1994. High-pressure treatment with a slurry of a liquid mixed with a ceramic particulate material ranging in size from 66 to 350 μm can be employed to implant the strengthening particles into the surface of a polymeric article. Similarly, impact implantation with electrically conductive or magnetic materials can be employed to attain a conductive surface or a surface having electromagnetic radiation absorption characteristics. In addition to water-jet impact implantation, also disclosed are methods of ultrasonic, sheet explosive, and mechanical particle implantation. Ceramic macro particle for implantation was selected from the group consisting of electro-corundum ($Al_2O_3$), boron-carbide (BC), silicone-carbide (SiC), titanium di-boride ($TiB_2$), boron nitride (BN), quartz ($SiO_2$), garnet, zirconium, or a mixture of the above. However, the above method is applicable for strengthening the surface of plastics only. Strengthening of a steel body by implanting a mixture of liquids, gas, and solid particles is not possible in the manner described in the patent.

The effect of the high-pressure stream, as suggested in the method, does not result in super-deep penetration. Therefore, such a method is not suitable for producing massive steel composite materials.

USSR Inventor's Certificate No. 800235 published in 1981 (inventors: S. Usherenko, et al) in Bulletin No. 4 discloses a complex process of manufacturing a cutting tool, including heat treatment, mechanical treatment, protection of areas that are not subjected to cementation, and gaseous cementation of remaining areas. Prior to cementation, the parts are spatially alloyed by a jet of powdered aluminum oxide with jet velocity ranging from 1.1 to 90 km/sec under pressure of $10^5$ to $10^8$ kg/cm$^2$. This method allows spatial rearrangement of the steel structure under conditions of super-deep penetration of the alloying material and produces a massive composite tool material. However, the method disclosed in the aforementioned Inventor's Certificate provides neither noticeable improvement in physical and mechanical properties of tool material such as high-speed steel nor uniformity of property changes over the length of the treated item.

Known also is a method of manufacturing an instrument disclosed in USSR Inventor's Certificate No. 703585 published in 1979 in Bulletin No. 46 (Inventor: C. Usherenko, et al). The method comprises volumetric strengthening of a cutting-tool insert with a high-speed jet of an alloying element, cleaning of the insert on the jet-introduction side for removal of micro-craters, soldering of the insert to the insert holder, sharpening of the cutting edges, and heat treatment. The process makes it possible to produce a mining cutting tool with a cutting insert from a composite tool material. However, the process does not provide uniformity of properties over the length of the cutting insert. Furthermore, heat treatment of the cutting tool in an assembled state (after soldering) decreases hardness of the holder material and thus shortens the tool service life because of low resistance of the holder to flexural deformations that occur under impact loads.

Another method described by U. A. Glasmacher et al, in Physical Review Letters, 96, 195701 (17 May 2006) relates to conversion of a solid-body structure into a composite material due to formation of local amorphous zones in the volume of graphite and zirconium. To achieve this effect, a solid body is irradiated with a flow of high-energy ions while being maintained under high pressure. However, manufacturing of composite materials by the method described in the above publication involves use of complex and expensive large-scale equipment that consumes a lot of energy and is not very productive.

Another method suitable for manufacturing a massive composite tool material is disclosed by O. Figovsky and S. Usherenko in Nanocomposite Tool Steels—Proc. Composites, Nano Engineering (ICCE 15), Haikou, Hainan Island, China, Hi. of the Orient, 15-21 Jul. 2007, p. 227-228. The article describes a method for manufacturing a nanocomposite that involves pulsed treatment of a steel blank in a mode of super-deep volumetric penetration and passage clusters jets of working medium) of ceramic microparticles ($Al_2O_3$) into and through the reinforcing structure of high-speed steel to the depth of 0.1 to 0.2 m. In up to 30% of the deeply penetrated volume, the particles form transverse reinforcing areas under conditions of accumulated energy (pressure), intense deformation, radiation flow of high-energy ions, and specific interaction of the introduced substance with the steel matrix in narrow and deep zones, with formation of fibrous metastable compounds in less than 1% of the volume and formation of areas having strong mechanical properties in up to 10% of the volume, i.e., without substantial change in the structural and physical characteristics of the original material. Final strengthening of the processed material is achieved after a final heat treatment. Nevertheless, the method described above still does not provide a composite tool material with mechanical properties of a sufficiently high level and uniformity over the depth.

SUMMARY OF THE INVENTION

Figure 1:
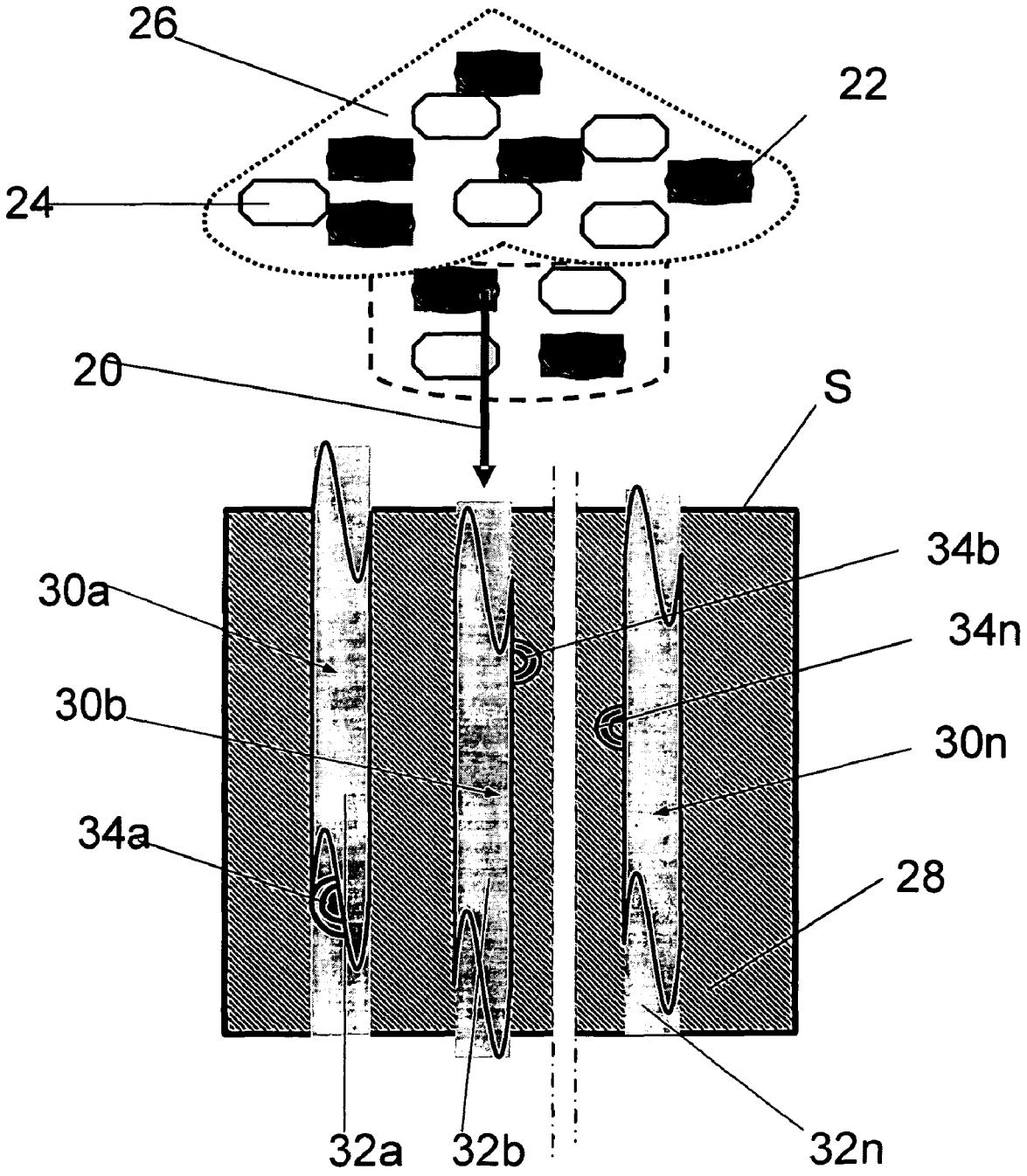
FIG. 1 is a schematic view illustrating penetration of the flow of working medium in the volume of a preform of initial tool steel for forming a composite steel material of the present invention.

It is an object of the invention to provide a method of strengthening a material, in particular, high-speed steel, by penetration of ceramic and other hard particles to a significant depth and even through the entire matrix of the treated material. In particular, the invention concerns a method of strengthening an HSS billets for converting this billet into a massive composite material suitable for manufacturing cutting-tool inserts, cutting tolls, or the like.

The method consists of manufacturing a composite tool material with high-speed steel. In particular, the method consists of impinging the surface of a body of a blank with a high-speed and high-energy pulsating jet of a specific working medium penetrating into and passing through the matrix of the treated material, thus restructuring and reinforcing the material with hard particles. First, a working medium is prepared from a mixture of particles having hardness greater than hardness of the tool material matrix, e.g., ceramic particles, ductile metallic powders having a melting point below the heating temperature of the working-medium jet and additional processing liquids. The components are mixed so that the fraction of the obtained mixture uniformly overlaps the range of 1 to 100 μm. The mixture is then formed into a jet of the working medium with a velocity having pulsation in the range of 200 to 6000 msec and with a density pulsating in the range of 0.1 to 1.3 (relative to the theoretical density of the working-medium material). In the longitudinal direction, the jet forms one to three portions similar in distribution of velocity and density. In each pulsation period, the material of the jet is heated to a temperature ranging from 100 to 2000° C. The pulsations occur during movement of discrete particles of the jet components toward the blank or blanks at a distance of about 1.5 to 3 transverse dimensions of the jet from the surface of the blank(s) and passes through the material of the blank(s) in the above-mentioned mode of super-deep penetration.

DETAILED DESCRIPTION OF THE INVENTION

The method consists of strengthening a material, e.g., a blank, by impinging the surface of a blank with a high-speed, high-energy density-pulsating jet of a specific working medium penetrating into and passing through the matrix of the treated material, thus restructuring and reinforcing the material with hard particles.

First, a working medium is prepared from a mixture of micron-size particles of ceramic, ductile metallic powders having a melting point below the heating temperature of the working medium jet and additional processing liquids. About 20 to 80 vol. % of the mixture consists of hard ceramic powders such as silicon carbides (SiC) or titanium carbides (TiCN). Individually, chemical elements of these powders do not form fragile compounds with the material of the high-speed steel matrix. The remaining part of the mixture (i.e., 80 to 20 vol. %) is formed from ductile metallic powders having a melting temperature below the heating temperature of the jet. Examples of these metals are nickel and copper, which do not form fragile compounds with the material of the high-speed steel. For example, in the mixture, silicon carbide of 3 to 250 μm fraction may constitute 40 to 60 vol. %, nickel powder of 1 to 100 μm fraction may constitute 40 to 50 vol. %, and powdered aluminum oxide (carborundum) of 20 to 50 μm fraction may constitute the balance. Alternatively, 20 to 80 vol. % may comprise a titanium carbonitride (TiNC) fraction of 1 to 100 μm fraction, 20 to 60 vol. % may comprise a nickel powder fraction of 1 to 100 μm, with the balance being silicon nitride powder of <1 μm to 60 μm fraction.

The components are mixed so that the fraction of the obtained mixture uniformly overlaps the range of 1 to 100 μm. The mixture is then formed into a pulsating jet of the working medium, with velocity having pulsation in the range of 200 to 600 m/sec and with density pulsating in the range of 0.1 to 1.3 (relative to the theoretical density of the working-medium material). During formation and acceleration of the pulsating jet, the component particles of the jet fuse, adhere to each other, and crash with uniform distribution that overlaps the aforementioned range of 1 to 100 μm. With velocity in the above-described range, the working medium can penetrate into a steel blank to the depth that is equivalent to 100 to 10000 diameters of the impinging particles (i.e., to the depth of 0.1 to 0.2 m).

In the longitudinal direction, the pulsating jet forms a plurality, e.g., one to three portions similar in distribution of velocity and density. In each pulsation period, the material of the jet is heated to a temperature ranging from 100 to 2000° C. The temperature of the jet is adjusted by using exo- and endothermic powder materials and/or by adding liquids, the evaporation of which decreases the jet temperature. The jet temperature may also be adjusted by controlling the thermal condition of gases in the jet acceleration portion of the process.

The pulsations occur during movement of discrete particles of the jet components toward the blank or blanks at a distance of about 1.5 to 3 transverse dimensions of the jet from the surface of the blank(s) and passes through the matrix material of the blank(s) in the above-mentioned mode of super-deep penetration.

Pressure that is realized during deep penetration of the working medium into the steel matrix reaches high values in the range of 8 to 12 GPa and is accompanied by intense deformation and generation of high-energy ions. Since the energy of a single ion is as high as 100 to 200 MV, this causes jumpwise fractionation of structural elements in the steel matrix on the macro- to micro-levels.

A directional explosion of explosive charges accelerates high-speed jet. Alternatively, the accelerators may be of a gunpowder, gaseous, electrical, or mechanical type.

The massive composite tool material obtained according to the aforementioned method on the basis of the high-speed steel matrix contains elongated zones of the additional alloying material of the working medium that penetrates into and passes through the high-speed steel matrix. These elongated alloying reinforcing zones, which are composed of the working medium introduced into the steel matrix, constitute 0.02 to 1% of the entire volume; about 1 to 10% of the volume constitutes reinforcing zones of nano- and micro-structures that are formed by restructuring the matrix material without any additional alloying, while 90 to 98% of the volume is occupied by the steel matrix that preserves its original physical and structural properties.

In addition to elongated longitudinal reinforcing zones oriented in the direction of the impinging jets, the material of the steel matrix also contains transverse elongated zones of the nano- and micro-structure. However, on the same depth of penetration in the transverse zones, the density per unit area does not exceed 10 to 30% of the density per unit area of the longitudinal zones. This condition provides the treated material with anisotropic structure and properties.

Figure 2:
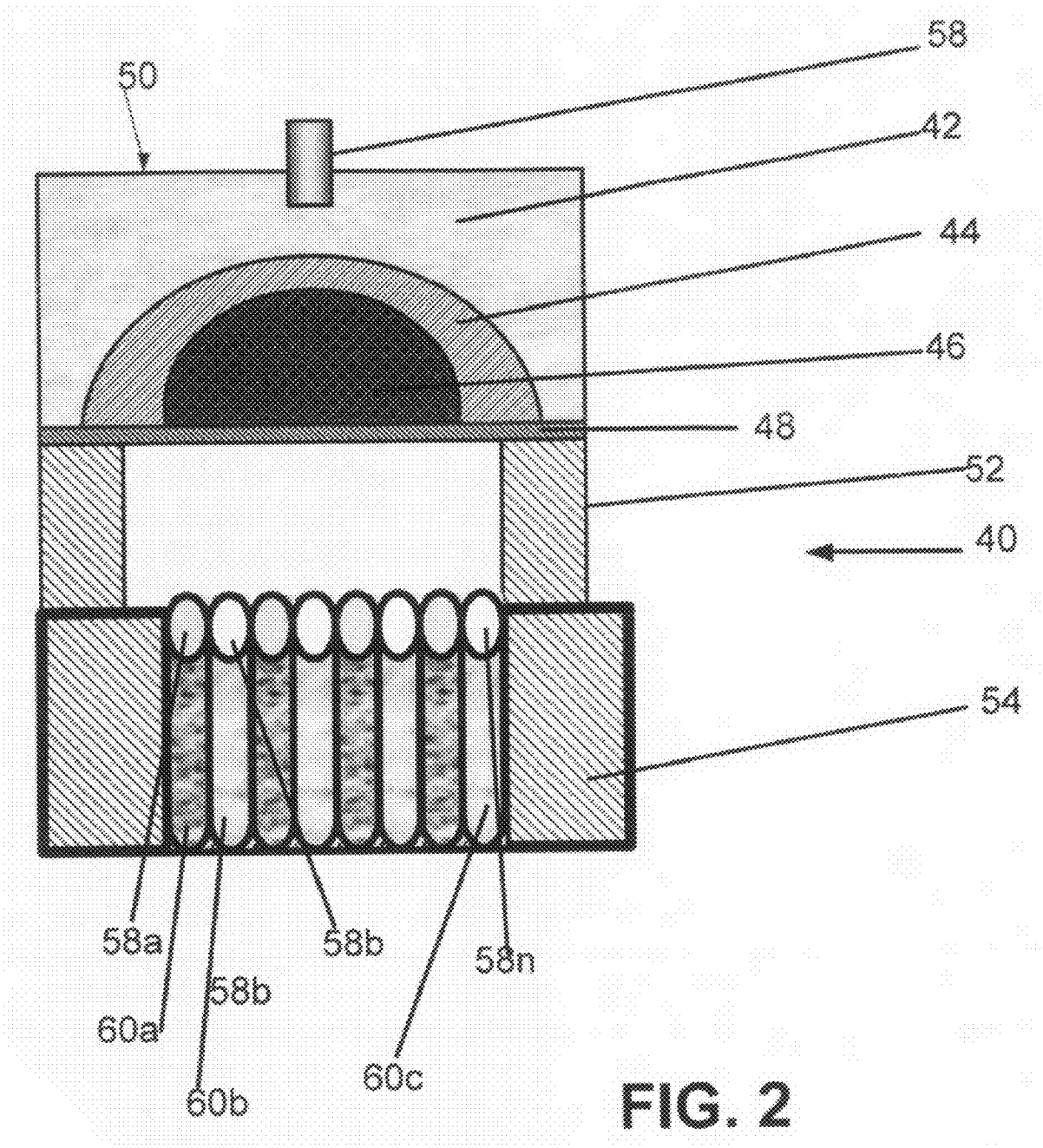
FIG. 2 is a schematic view of the apparatus for carrying out the method of the invention.

The method of the invention will now be described in more detail with reference to FIGS. 1 and 2. FIG. 1 is a schematic view illustrating penetration of the flow of working medium in the volume of a preform of initial tool steel for forming the composite steel material of the present invention. FIG. 2 is a schematic view of the apparatus for carrying out the method of the invention.

In FIG. 1, reference numeral 20 designates a high-speed, high-energy pulsating jet of a working medium formed, e.g., from a mixture of micron-size particles 22 of ceramic, particles 24 of a ductile metallic powder having a melting point below the heating temperature of the working medium jet 20, and an additional processing liquid 26. The jet 20 is directed toward the surface of a high-speed steel blank 28. The direction shown in FIG. 1, which is perpendicular to the surface S of the steel blank 28 and indicated by arrow A, is the main (predominant) direction of movement of microparticles into and through the volume of the steel blank.

Under conditions of super-deep penetration, the working medium composed of ceramic particles 22, ductile metal particles 24, etc., collide with the surface of the steel matrix 28 and penetrate into the steel matrix where in the form of fragments (of the particles of the working medium and products of interaction between the particles of the working medium) and fragments of new structural formations (products of interaction of the working medium with the steel matrix and fragments of the fine-structure zones), the aforementioned fragments form elongated zones 30*a*, 30*b*, . . . 30*n*, extending to the depth of 0.1 to 0.2 m from the surface of the blank.

When the fragments of the working-medium particles pass through the matrix material, they form physical and chemical interactions in the pierced areas zones 32*a*, 32*b*, . . . 32*n*, 34*a*, 34*b*, . . . 34*n* that change the micro- and nano-structure of the matrix 28.

In the steel matrix, the restructured zones 32*a*, 32*b*, . . . 32*n*. 34*a*, 34*b*, . . . 34*n* constitute activated regions. During subsequent heat treatment of the high-speed steel blanks processed according to the above-described method, the activated regions accelerate diffusion processes and facilitate completion of structural changes, including those in the steel matrix (blank) 28. As a result, the metallic matrix is converted into a massive, homogenously strengthened composite material, e.g., with anisotropic mechanical properties.

The fragments and new structural formations 32*a*, 32*b*, . . . 32*n*. 34*a*, 34*b*, . . . 34*n* have essentially uniform distribution in the material of the blank predominantly in the longitudinal and transverse directions, i.e., in the depth direction and in the direction perpendicular to the depth direction of the blank 28. Among other things, concentration of the fragments and new structural formations will depend mainly on the dimensions of the introduced particles.

In order for the fraction of the obtained mixture to overlap in the range of 1 to 100 μm, the jet of the working medium that penetrates into the material of the matrix is formed from a mixture of particles of ceramic, ductile metal powders having a melting point below the heating temperature of the jet, and additional technological liquids. Particles having dimensions beyond the aforementioned range (1 to 100 μm) do not penetrate into the steel matrix but create a variable pressure field that acts as an additional obstacle for super-deep penetration. If the particles are smaller than 1 μm, they are retarded on the surface of the blank, and if the size of the particles exceeds 100 μm, they also are stopped on the surface of the blank. Dimensions of striking elements, which are formed from the jet particles, may increase because of aggregation or fusion or may decrease because of disintegration or destruction. Therefore, the optimal dimensions and contents of the mixed components were determined experimentally and correspond to the examples given above. More specifically, silicon carbide fraction has dimensions of 3 to 250 μm and constitutes 40 to 60 vol. %, nickel fraction has dimensions of 1 to 100 μm and constitutes 40 to 50 vol. %, aluminum oxide (carborundum) fraction has dimensions of 20 to 50 μm and constitutes the balance. Another optimal combination is the following: titanium carbonitride in the amount of 20 to 80 vol. % (TiNC) with dimensions in the range of 1 to 100 μm, a nickel powder fraction in the amount of 20 to 60 vol. % with dimensions in the range of 1 to 100 μm, and <1 μm to 60 μm fraction of silicon nitride powder as the balance.

According to the invention, selection of the working-medium composition depends on specific conditions of tool operation. For example, when it is necessary to improve wear resistance of the tool (to friction) under operational conditions without large impact loads and wear, the material should include (but need not be limited to) components such as silicon carbide, titanium carbide, titanium carbonitride, vanadium carbide, and nickel, individually or in mixtures. For tools operating under conditions of increased dynamic loads, the aforementioned composition may additionally include fused aluminum oxides (electrocarborundum), iron, silicon nitride, individually or in mixture.

When material of the working medium that comprises a mixture of ceramic particles 22, ceramic, ductile metallic particles, and an additional processing liquid 26 penetrate into the steel matrix 28 (FIG. 1), this material forms elongated alloyed zones in the steel matrix that occupy up to 1% of the matrix volume and nano- and micro-structured zones that occupy up to 10% of the matrix volume. These restructured zones of the matrix are formed without any additional alloying and do not change physical and structuring characteristics of the remaining 90 vol. % of the matrix material.

In the obtained composite material, desired properties and structures can be obtained by changing operational parameters such as jet velocity, density gradient of the working medium in the jet, fractions and composition of the working medium at the jet-formation stage, length and diameter of the jet 20 from the source of acceleration (not shown in FIG. 1) to the surface S of the blank 28, and length of the accelerating (adjusting) section. Therefore, the initial geometry of the jet, which is defined by the geometry of the acceleration source (e.g., a shell of the cumulative charge of the explosive substance, which will be described later with reference to FIG. 2), is destabilized in a desired manner in the length direction of the jet in the velocity range of 200 to 6000 m/sec and in the density range of 0.1 to 1.3 (relative to the theoretical density of the working-medium material). In this process, several, e.g., one to three elongated zones similar in distribution and density, are formed in the jet. At the stage of formation and acceleration, the material of the jet is heated to a temperature of 100 to 2000° C., while pulsation of the jet occurs on the acceleration section having a length of 1 to 3 diameters of the jet.

Desired structural and physical characteristics of the composite steel material can be obtained by selecting components of the working medium and products of their interaction. For example, ceramic materials that possess high resistance to wear can be used for improving wear-resistant properties of the cutting tool used in the mining industry for cutting minerals or tools designed for cutting metals or other materials, as well as for reducing the temperature of sparks that may occur during cutting, which is especially important when operations are carried out in mines. The use of ductile metals provides more uniform change of properties in the depth direction.

It is important to form the working medium from components that will not form fragile substances during interaction of the material with the high-speed steel matrix or during subsequent heat treatment. For example, the working medium will not contain boron-based components for spatial strengthening of the steel matrix. Organic materials can be included into the composition of the working medium only if the accelerators operate without generating high temperature during acceleration and collision. Therefore, organic materials cannot be used in association with explosive-type accelerators.

Although the material of the working medium is preferably solid, in some applications the working medium may also contain liquid additives. For example, easily volatile liquids such as alcohol can be added when it is necessary to neutralize or reduce oxidation of the particles by gases in the acceleration portion of the process (i.e., in the shell 44, the working medium 46, the plate 48, the adjusting support 52, and the container 54). Such liquids are also used to enhance evaporation of liquids, such as water, from the material of the working medium prior to collision of particles with the steel blank in order to prevent particle aggregation and changes in the mode of super-deep penetration that may occur when the dimensions of the striking particles become greater than critical one (about 100 μm). In the velocity range of 200 to 6000 m/sec, the maximal critical dimensions may vary from 70 to 100 μm. The minimal critical dimensions is 1 μm. Liquid additives are selected so as to minimize chemical interaction thereof with particles of the working medium, to prevent sticking of the particles to each other during the preparation stage of the working medium and formation of the jet, and to prevent formation of cavities in the steel blanks during the stage of particle penetration into the solid body of steel matrix where such cavities may occur as a result of evaporation of working-medium liquids or transfer thereof into a plasma state. The use of such liquid additives does not reduce the mechanical properties of the composite tool material. The liquid additives suitable for the purpose of the invention should not contain oxidizers such as $O_2$, F. Cl, etc. Examples of the liquid additives are the following: ethyl and methyl alcohols, kerosene, benzene, various oils, etc.

Materials of the working medium based on the use of various forms of carbon and carbon compounds also can be introduced into the material of the blank to improve hardening properties, e.g., in the manufacture of a composite material having hardness higher than the initial steel. Conversion of conventional high-speed steel into composite high-speed tool steel is completed during diffusion processes at the heat-treatment stage.

It is an advantage of the method of the present invention that while introduction of the working-medium jet into the high-speed steel does not essentially change the initial composition of the steel matrix, the structure and properties of the steel matrix change significantly. Therefore, heat-treatment conditions remain the same as for conventional high-speed steel. Final heat-treatment conditions can be changed depending on the composition of the jet and mode of introduction of the jet into the matrix of the material to be treated.

Since after completion of heat treatment the tool material of the invention acquires improved resistance to wear, mechanical treatment of instrument parts made from this material must be carried out before heat treatment. Therefore, treatment such as polishing is carried out either before or after assembling the cutting tool.

FIG. 2 is a schematic view of the apparatus for carrying out the method of the invention. The apparatus has an accelerator 40 based on the use of a brisant explosive charge 42, which rests on a shell 44 that has an open end and is filled with the aforementioned working medium 46. The open end of the shell 44 is closed with a metal plate 48. The explosive charge 42, the shell 44 with the explosive charge 42, and the metal plate can be connected to with the use of an adhesive. The plate 48 and the shell 44 can be made from a metal sheet 48, e.g., from an aluminum sheet. The plate 48 and the shell with the working medium 46 form a cartridge 50 that can be stored and transported in a separate plate. Prior to use, the cartridge 50 is placed into a recess of the brisant explosive charge 42, and the assembly is installed onto a steel adjusting support 52, which, in turn, rests on a steel container 54 that retains high-speed steel blanks 54*a*, 56*b*, . . . 56*n*. The blanks are packed into the container 54 in a dense manner in order to provide tight contact between their mating side surfaces.

An electric detonator 58 is then installed in a manner known in the art into the upper end of the explosive charge, and the detonator 58 is activated. This causes explosion of the explosive charge 42. The explosion compresses the shell 44 and the working medium 46 contained therein up to 1.3 of the theoretical density and converts the working medium into a jet 20 (FIG. 1) of a given range of density and high velocity in the range of 200 to 6000 m/sec. The jet 20 pierces the plate 48, passes through the adjusting support 52, and acts on the surface of the steel blanks located in the container 54.

The high-velocity jet 20 (FIG. 1) accelerates the microparticles of the working medium within the interior of the adjusting support 52 and restricts expansion of the jet beyond the limits of the inner surface of the adjusting support 52. Various commercially available accelerators are capable of accelerating microparticles that have dimensions in the range from 1 to 500 μm to velocities of 300 to 6000 m/sec. Explosion-type accelerators are preferable for the present invention since they additionally can fuse ceramic particles, disintegrate them, and mix the working medium 46, thus providing velocity and density ranges of the jet required for deep penetration of the particles into the steel matrix. The interior of the adjusting support 52 may contain air, gases, or a gas-steam mixture under normal or elevated pressure. If necessary and economically justifiable, the interiors of adjusting support 52 and container 54 can be evacuated.

It is understood that characteristics of the working-medium jet will depend on the structure and materials of the explosion-type accelerator 40 (FIG. 2). Under specific application conditions, the jet particles can be accelerated by accelerators of a gaseous type, a gunpowder type, an electrical type, etc.

At the stage of action of the jets 20 (FIG. 1) on the blanks 56*a*, 56*b*, . . . 56*n*, the blanks move simultaneously with the container 54. This movement provides the given acceleration length which is 1.5 to 3 times the cross-section of the jet 20. Other results are high productivity of the pulsed treatment and preservation of the blanks.

It is preferable that during operation the blanks be systematically moved down in the direction of the jet in order to provide more uniform introduction of the working medium into the body of the steel blank and, hence, more uniform distribution of the working medium in the material of the steel blank. The paths of such movements are shown in FIG. 2 by reference numerals 60*a*, 60*b*, . . . 60*n*. If necessary, however, the jets of the working medium can be oriented in other directions as well by means of special additional devices and attachments (not shown). Although the use of explosive-type accelerators is preferable for bombardment of the steel blanks in the mode of super-deep penetration, the working medium can be accelerated by accelerators of a gunpowder type, a gaseous type, an electrical type, etc.

The invention will be further described with reference to practical examples, which, however, should not be construed as limiting the scope of practical application of the invention.

Example 1

A specimen of an HSS type (6% W, 5% Mo) was treated according to the method of the invention with use of a jet of a working medium introduced into the end face of the specimen. Along its length, the jet had three portions similar to each other in velocity and density and was formed with instability in the lengthwise direction in the velocity range of 200 to 3000 m/sec and in the density range of 0.1 to 1.3 (with reference to the theoretical density of the working medium).

The specimen comprised a cylindrical steel body of about 40 mm in diameter and 100 mm in length and was mechanically treated to a smooth surface. The steel cylindrical specimen was installed vertically with a sliding fit in the opening of the container 54 (FIG. 2) and below the adjusting support 52 of the type described above with reference to FIG. 2. The support was adjusted to dimensions that after compression of the shell 44 of the cartridge 50 with the energy of the explosion could provide and guide a working-medium jet having a diameter of about 40 mm to the end face of the steel blank.

The working medium was prepared by mixing in a mechanical mixer for 10 min., and the mixture was then loaded into a container formed by the aluminum shell 44 and the aluminum plate 48 (FIG. 2), which were attached to each other by plasticene. The shell and the plate had a thickness of 1.5 mm. The cartridge 50 assembled from the aforementioned parts and containing the working medium was placed into the explosive charge 42, which had a mass of 0.2 kg and a detonation velocity of 6,000 m/sec. The inner cavity of the adjusting support 52 had a length of 100 mm, an upper diameter of 50 mm, and a diameter of 42 mm. The inner cavity of the blank-holding container 54 had a length of 150 mm and a diameter of 40 mm.

The accelerator of the working medium together with the adjusting support and the cartridge 50 (FIG. 2.) was installed in an explosion-proof chamber on a sandy base, and the explosion was initiated by means of the electrical detonator 58. The mass of the working medium, which was accelerated to velocities of 300 to 2500 m/sec and to dens of 0.2 to 0.9 with reference to the theoretical density of the working medium, penetrated the upper surface of the cylindrical blank down to the entire depth of the blank. The duration of the pulsed penetration of the working medium into the steel matrix did not exceed $10^{-4}$ sec.

Because of development of super-high-pulse pressure within the cumulative recess of the charge, the density of the working substance became greater than theoretically possible for such a material. This caused the material of the working substance to flow and to form a high-speed jet 20 (FIG. 1). This jet broke the metallic plate 48 and moved within the interior of the adjusting support 52 toward the blanks 58*a*, 58*b* . . . 58*n*. The jet continued to develop inside the inner cavity of the adjusting support 52, but the transverse dimensions of the jet were limited by the inner diameter of the adjusting support 52, while the longitudinal dimensions of the jet at this stage corresponded approximately to the length of the adjusting support 52.

The blanks 52*a*, 52*b*, . . . 58*n* were placed from the lower end of the shell 44, in particular from the lower surface of the metallic plate 48, at a distance that exceeded one or two diameters of the lower, i.e., open end of the shell 44 that contained the working medium 46. When the jet collided with the upper surface of the steel blank (which had a diameter of 40 mm), a portion of the jet was reflected from the surface, thus creating high-pressure pulses, while another part of the jet penetrated the area of high pressure in the mode of super-high penetration. In some local areas, this generated high pressure up to 8 to 12 GPa simultaneously with intensive deformation of the blank material and irradiation with an ion flow having unit energy from 100 to 200 mega Ev. This caused abrupt diminution of the structure in the aforementioned local areas, with formation of elongated zones of nano- and microstructures in the longitudinal and transverse directions of the blanks. In these elongated zones, the material of the matrix was alloyed and formed into a composite material. The aforementioned transverse zones occurred when microparticles of the working substance turned toward the side surface of the blank, but the unit density of the transversely oriented particles did not exceed 30% of the particles in the longitudinal direction in the same depth. The difference in densities facilitated the desired formation of the composite material structure in which the areas alloyed with the particles of the working medium did not exceed 1%, and the area with a modified structure did not exceed 10% of the matrix volume.

The above-described treatment of the high-speed steel matrix with super-deep penetration of particles of the working medium into steel blanks after heat treatment typical for steel of this type (hardening and annealing) resulted in the formation of a composite suitable for manufacturing cutting tools.

Damage on the surface of the steel blank caused by the above-described pulsed treatment did not exceed 1 to 2 mm in depth. The damaged portion was removed. Four mixtures, the composition of which is shown in Table 1, were used for treating steel blanks according to the method of the invention. Upon completion of super-deep penetration, the blanks were subjected to mechanical and heat treatment as well as to comparative mechanical tests. The results of the tests are shown in Table 2.

TABLE 1

Compositions of Working-Medium Mixtures Used for Treating Steel Blanks

| Test No. | Composition |
|---|---|
| 1 | TiCN (1-100 μm) 60% + Ni (1-100 μm) 30% + $Si_3N_4$ (0-60 μm) 10% |
| 2 | TiCN (80-100 μm) 60% + Ni (10-30 μm) 30% + $Si_3N_4$ (60-80 μm) 10% |
| 3 | TiCN (1-100 μm) 100% |
| 4 | TiCN (1-100 μm) 50% + Ni (1-100 μm) 30% + $Si_3N_4$ (0-60 μm) 10% + ethyl alcohol 10% |

TABLE 2

Mechanical Properties of Composite Tool Material After Treatment According to Method of Invention

| | | Strength with Reference to Untreated Steel | | |
|---|---|---|---|---|
| Test No. | Composition No. | Resistance to Wear | Flexural Strength | Impact Strength |
| 1 | — | 1 | 1 | 1 |
| 2 | 1 | 1.3 | 1.15 | 1.2 |
| 3 | 2 | 1.05 | 0.8 | 0.9 |
| 4 | 3 | 1.1 | 0.7 | 0.65 |
| 5 | 4 | 1.35 | 1.1 | 1 |

Data in Table 2 show that deviation of the working medium from the optimal Composition 1 generally impairs the mechanical properties of the complex material. This is especially noticeable in Compositions 2 and 3 (shown above). The addition of ethyl alcohol made it possible to slightly improve resistance to wear, while flexural strength and impact strength dropped to the level of untreated steel.

Example 2

In this experiment, the accelerator used was the same as that in Example 1. The material of the blank steel and the dimensions of the blanks also were the same as those in Example 1. Upon completion of super-deep penetration with use of the working-medium jet in accordance with the scheme shown in FIG. 2, the treated blanks were subjected to the same mechanical treatment as in the preceding example. Example 2 differs from Example 1 in that the working-medium composition was prepared on the basis of ceramic powder of silicon carbide (shown in Table 3).

TABLE 3

Compositions of Working-Medium Mixtures

| Test No. | Composition |
|---|---|
| 1 | SiC (3-250 μm) 50% + Ni (1-100 μm) 40% + $Al_2O_3$ (20-50 μm) 10% |
| 2 | SiC (3-250 μm) 100% |
| 3 | SiC (3-250 μm) 10% + Ni (1-100 μm) 20% + $Al_2O_3$ (20-50 μm) 70% |
| 4 | SiC (3-250 μm) 50% + Ni (1-100 μm) 50% |
| 5 | SiC (3-250 μm) 10% + Ni (1-100 μm) 20% + $TiB_2$ (40-50 μm) 70% |

As shown in Table 4 below, deviation from the optimal composition essentially changed the mechanical properties of the obtained composite tool materials.

TABLE 4

Mechanical Properties of Composite Tool Material After Treatment According to Method of Invention on Basis of Silicon Carbide

| | | Strength with Reference to Untreated Steel | | |
|---|---|---|---|---|
| Test No. | Composition No. | Resistance to Wear | Flexural Strength | Impact Strength |
| 1 | — | 1 | 1 | 1 |
| 2 | 1 | 1.55 | 1.1 | 1.25 |

TABLE 4-continued

Mechanical Properties of Composite Tool Material After Treatment According to Method of Invention on Basis of Silicon Carbide

| Test No. | Composition No. | Strength with Reference to Untreated Steel: Resistance to Wear | Flexural Strength | Impact Strength |
|---|---|---|---|---|
| 3 | 2 | 1.05 | 0.7 | 0.6 |
| 4 | 3 | 1.1 | 1.3 | 1.22 |
| 5 | 4 | 1.07 | 1.0 | 0.7 |
| 6 | 5 | 1.4 | 0.5 | 0.2 |

Impairment in properties of tool materials with the use of Composition 2 (Table 3) was associated with the absence of ductile materials in the composition of the mixture. A sharp deterioration in flexural and impact strength in Test 6 (Table 4) was caused by using a high concentration of titanium diboride in Composition 5 (Table 3). The use of Composition 4 (Table 3) to obtain a composite tool material was advantageous when this tool material was intended for operation under conditions of high wear but low-impact loads. Changes in the properties of the tool materials having compositions listed in Table 4 significantly differed from the changes in properties of the tool materials having compositions listed in Table 2.

Measurements were taken of the anisotropic mechanical properties of the composite tool material obtained with Composition 4 in Table 3. Measurement results showed that resistance to wear in the transverse direction increased by 14%, and resistance to wear in the longitudinal direction increased by 1.7 times. Impact strength of the obtained tool material in the transverse direction was reduced by 30% and was increased by 20% in the longitudinal direction. Flexural strength of the tool material changed insignificantly in the longitudinal and transverse directions and approximately corresponded to the flexural strength characteristics of the steel matrix.

When the above-described tool materials were used for the manufacturing of cutting inserts for rotary mining tools, they were self-sharpened during operation. This improved the performance characteristics and service life of the tool.

Example 3

Specimens of the composite tool material were manufactured and tested in the same manner as in Example 1 with regard to mechanical properties. The main distinction of Example 3 is that the initial size of the working medium particles differed from those used in Example 1.

The composites used are shown in Table 5, and the results of mechanical tests of the obtained composite materials are shown in Table 6.

TABLE 5

Compositions of Working-Medium Mixtures Used for Treating Steel Blanks

| Test No. | Composition |
|---|---|
| 1 | TiCN (1-100 μm) 60% + Ni (1-100 μm) 30% + $Si_3N_4$ (0-60 μm) 10% |
| 2 | TiCN (3-14 μm) 60% + Ni (0-20 μm) 30% + $Si_3N_4$ (40-50 μm) 10% |

TABLE 5-continued

Compositions of Working-Medium Mixtures Used for Treating Steel Blanks

| Test No. | Composition |
|---|---|
| 3 | TiCN (100-160 μm) 60% + Ni (120-200 μm) 30% + $Si_3N_4$ (3-14 μm) 10% |
| 4 | TiCN (120-160 μm) 60% + Ni (120-200 μm) 40% |

TABLE 6

Mechanical Properties of Composite Tool Material After Treatment by Method of Invention with Use of Compositions in Table 5

| Test No. | Composition No. | Strength with Reference to Untreated Steel: Resistance to Wear | Flexural Strength | Impact Strength |
|---|---|---|---|---|
| 1 | — | 1 | 1 | 1 |
| 2 | 1 | 1.3 | 1.15 | 1.2 |
| 3 | 2 | 1.1 | 0.95 | 0.95 |
| 4 | 3 | 1.0 | 1.05 | 0.98 |
| 5 | 4 | 0.95 | 1 | 1 |

The obtained results of the mechanical tests showed that use of Compositions 3 and 4 (Table 5) did not produce changes inherent in super-deep penetration. A slight deviation in mechanical properties from those of the initial steel matrix, which was observed in Composition 3, was associated with the presence of the 3 to 14 μm silicon-nitride fraction in this composition. Composition 2, which consisted of the same chemical components of the mixture (Table 6), had mechanical properties lower than those in Composition 1. This was caused by deviation in particle size from optimal values. Thus, if the fraction of the obtained mixture did not uniformly overlap from 1 to 100 μm, the material could not be effectively strengthened. When the particles that formed the jet had dimensions beyond the range of 1 to 100 μm, the objects of the invention could not be achieved.

Example 4

The samples of composite tool material were manufactured and tested in accordance with the procedure of Example 1. The main difference from Example 1 is that the range of speed and density of the jet changed. This change was achieved mainly because of the use of explosives having different detonation velocities and geometries from those of the accelerating section. The list of tests with different velocities and densities are shown in Table 7.

TABLE 7

Tests Conducted at Various Jet Velocities and Densities

| Test No. | Range of Jet Parameters Over Velocity and Density (TiCN (1-100 μm) 60% + Ni (1-100 μm) 30% + $Si_3N_4$ (0-60 μm) 10% |
|---|---|
| 1 | 200-6000 m/sec; 0.1-1.3 of working-medium theoretical density |
| 2 | 200-3000 m/sec; 0.1-1.3 of working-medium theoretical density |
| 3 | 100-200 m/sec; 0.01-0.1 of working-medium theoretical density |
| 4 | 100-300 m/sec; 0.05-0.5 of working-medium theoretical density |

TABLE 7-continued

Tests Conducted at Various Jet Velocities and Densities

| Test No. | Range of Jet Parameters Over Velocity and Density (TiCN (1-100 μm) 60% + Ni (1-100 μm) 30% + $Si_3N_4$ (0-60 μm) 10% |
|---|---|
| 5 | 3000-6000 m/sec; 0.05-1.1 of working-medium theoretical density |
| 6 | 6000-8000 m/sec; 0.05-0.3 of working-medium theoretical density |

TABLE 8

Results of Tests Shown in Table 7

| Test No. | Effective Depth of Strengthening Steel Matrix (m) | Relative Wear Resistance | Notes |
|---|---|---|---|
| 1 | 0.2 | 1.25 | Depth of surface damage and chipping up to 7 mm |
| 2 | 0.15 | 1.3 | Depth of surface damage up to 1.5 mm |
| 3 | — | 1 | Surface coating without super-deep penetration |
| 4 | 0.011 | 1.45 | Surface coating and volumetric strengthening |
| 5 | 0.21 | 1.11 | Surface deterioration and chipping up to 5 mm |
| 6 | 0.055 | 1.15 | Depth of chipping up to 17 mm; destruction |

Optimal conditions were achieved in Test 2 since, along with deep rearrangement of the steel matrix by strengthening, the steel blanks remained undamaged. The increase in velocity (Test 1) caused greater deterioration of the blank surfaces, with the appearance of cracks and chipping. In Test 5, in spite of the increased depth of strengthening, the treatment did not result in significant improvement of wear-resistant properties but rather led to surface damage. In Test 6, the effect of super-deep penetration was achieved but led to damage of the steel matrix to the extent that excluded normal use. In Test 3, the blanks remained undamaged, but super-deep penetration was not achieved. Tests 3 and 4 were realized on the basis of gunpowder-type accelerators. The conditions in Test 4 improved resistance to wear due to relatively low depth of penetration and, hence, due to increased concentration of the penetrated substance. In all tests under conditions corresponding to the present invention, super-deep penetration and volumetric strengthening were achieved without damaging the steel blanks.

Example 5

The specimens of the composite tool materials were manufactured and tested with regard to their mechanical properties in accordance with Example 1. The main difference from Example 1 is that while using the composition of Table 1, the ranges of volume and density changed. Variations of velocity and density were achieved by using explosive substances having different detonation velocities and by changing the geometry of the accelerating portions. The number of similar elongated portions in the lengthwise direction of the jet depended on the geometry of the recess formed in the explosive for the working-medium mixture.

Listed in Table 9 are the tests used to form one to three elongated portions in the direction of the jet similar in velocity and density distribution. Uniformity of penetration distribution over the cross-section in the area of penetration was determined as a percentage of the area having dense distribution of the elongated channel elements in the structure.

TABLE 9

Test for Stepwise Destabilization of Working-Medium Jet

| Test No. | No. of Similar Portions | Penetrated Area of Blank (%) | Relative Wear Resistance | Notes |
|---|---|---|---|---|
| 1 | 1 | 67 | 1.18 | Nonuniform distribution |
| 2 | 2 | 84 | 1.26 | Relatively uniform distribution |
| 3 | 3 | 100 | 1.3 | Uniform distribution |
| 4 | 4 | 58 | 1.1 | Nonuniform distribution, plus chipping |

Super-deep penetration in accordance with the procedure of Test 3 under conditions specified in Table 9 provided uniform distribution of the zones of penetration across the steel blank, along with maximal resistance of the composite tool material to wear.

Example 6

It was proposed to conduct this test by incorporating into the working-medium mixture powders of ductile metals having the melting point below the jet heating temperature. The temperature of the jet affects the composition of the working medium and hence the properties of the obtained composite tool material produced by the method of the invention. The temperature is adjusted by adding exo- and endo-thermal powder materials, or by adding liquids evaporation of which decreases the jet temperature. The temperature can also be adjusted by controlling the temperature of gases in the jet acceleration portion. Composition of the working medium used in this test was the same as in Table 1.

Specimens of the composite tool material were manufactured and tested with regard to their mechanical properties in the same manner as in Example 1. The list of tests performed at different temperatures of the working-medium jets are shown in Table 10.

TABLE 10

Results of Tests at Different Temperatures of Working-Medium Jets

| Test No. | Jet Temperature (° C.) | Relative Wear Resistance | Notes |
|---|---|---|---|
| 1 | 61 | 1 | Ni replaced by 50% of bismuth, 12.5% of tin, 25% of lead, and 12.5% of cadmium |
| 2 | 100 | 1.05 | Ni replaced by 40% of bismuth, 40.0% of tin, and 20% of lead |
| 3 | 1500 | 1.3 | Composition from Table 1 |
| 4 | 2000 | 1.42 | Chromium used instead of nickel |
| 5 | 2200 | 1.05 | Composition from Table 1 |

As can be seen from Table 10, the optimal conditions for manufacture of the composite tool material were obtained at a jet temperature of 100 to 2000° C. Use of ductile metal powders was hindered by their toxicity and high cost. Cooling of the jet to a temperature below 100° C. or heating to a temperature above 2000° C. presented a problem for use of explosion-type accelerators in view of complication of structure and increase in cost.

I claim:

1. A method of strengthening a metallic tool material by penetration of reinforcing particles into said tool material comprising:

providing at least one blank of the tool material suitable for penetration of the reinforcing particles;

preparing a working medium in the form of a uniform mixture of the reinforcing particles comprising at least particles having hardness greater than the hardness of the tool material and particles of a ductile metallic powder, the size of the reinforcing particles and particles of the ductile metallic powder being in the range of 1 to 100 μm;

forming the working medium into a pulsating jet having a velocity in the range of 200 to 6000 m/sec and a temperature in the range 100 to 2000° C.;

impinging the at least one blank of the tool material with the pulsating jet of the working medium and passing the working medium through the tool material, the working medium in the pulsating jet having a theoretical density, and the pulsating jet having a transverse dimension; and strengthening the tool material by forming elongated alloying zones composed of the particles of the working medium oriented in the direction of the jet and restructured zones formed by restructuring the tool material under the effect of the pulsating jet.

2. The method of claim 1, wherein the step of forming the working medium into a pulsating jet having velocity in the range of 200 to 6000 m/sec and a temperature in the range 100 to 2000° C. comprises: providing an explosive material; positioning the explosive material in front of the at least one blank; forming a metallic shell on the side of the explosive material positioned in front of the at least one blank, said shell having an open end that faces the at least one blank, the open end having an open-end diameter; filling the shell with the mixture of the working medium; positioning the explosive material with the working medium at a distance that exceeds at least one open-end diameter of the shell that contains the working medium; and activating the explosive material.

3. The method of claim 1, wherein the tool material is a high-speed steel.

4. The method of claim 2, wherein the tool material is a high-speed steel.

5. The method of claim 3, wherein the ductile metallic powder has a melting point below the temperature of the working-medium jet.

6. The method of claim 4, wherein the ductile metallic powder has a melting point below the temperature of the working-medium jet.

7. The method of claim 6, wherein the particles having hardness greater than hardness of the tool material are selected from silicon carbide and aluminum oxide, and particles of ductile metallic powder are selected from nickel and copper.

8. The method of claim 4, wherein the working medium further comprises an additional process liquid selected from ethyl alcohol, methyl alcohol, kerosene, benzene, and oil.

9. The method of claim 5, wherein the working medium further comprises an additional process liquid selected from ethyl alcohol, methyl alcohol, kerosene, benzene, and oil.

10. The method of claim 4, wherein the step of forming the working medium into a pulsating jet having velocity in the range of 200 to 6000 m/sec and a temperature in the range 100 to 2000° C. comprises: providing an explosive material; positioning the explosive material in front of the at least one blank; forming a metallic shell on the side of the explosive material positioned in front of the at least one blank, said shell having an open end facing the at least one blank, the open end having an open-end diameter; filling the shell with the mixture of the working medium; positioning the explosive material with the working medium at a distance that exceeds at least one open-end diameter of the shell that contains the working medium; and activating the explosive material.

11. The method of claim 8, wherein the step of forming the working medium into a pulsating jet having velocity in the range of 200 to 6000 m/sec and a temperature in the range 100 to 2000° C. comprises: providing an explosive material; positioning the explosive material in front of the at least one blank; forming a metallic shell on the side of the explosive material positioned in front of the at least one blank, said shell having an open end facing the at least one blank, the open end having an open-end diameter; filling the shell with the mixture of the working medium; positioning the explosive material with the working medium at a distance that exceeds at least one open-end diameter of the shell that contains the working medium; and activating the explosive material.

12. The method of claim 9, wherein the step of forming the working medium into a pulsating jet having velocity in the range of 200 to 6000 m/sec and a temperature in the range 100 to 2000° C. comprises: providing an explosive material; positioning the explosive material in front of the at least one blank; forming a metallic shell on the side of the explosive material positioned in front of the at least one blank, said shell having an open end facing the at least one blank, the open end having an open-end diameter; filling the shell with the mixture of the working medium; positioning the explosive material with the working medium at a distance that exceeds at least one open-end diameter of the shell that contains the working medium; and activating the explosive material.

13. The method of claim 3, wherein the elongated alloyed zones occupy less than 1 vol. % and the restructured zones occupy less than 10 vol. % of the high speed steel matrix and wherein a plurality of alloyed and restructured zones similar in distribution of velocity and density are formed in the obtained composite tool material.

14. The method of claim 7, wherein the elongated alloyed zones occupy less than 1 vol. % and the restructured zones occupy less than 10 vol. % of the high speed steel matrix and wherein a plurality of alloyed and restructured zones similar in distribution of velocity and density are formed in the obtained composite tool material.

15. The method of claim 14, wherein the particles having hardness greater than hardness of the tool material are selected from silicon carbide and aluminum oxide, and particles of ductile metallic powder are selected from nickel and copper.

16. The method of claim 1, wherein the pulsating jet has density pulsating in the range of 0.1 to 1.3 relative to the theoretical density of the working medium material of the pulsating jet.

17. The method of claim 16, wherein the pulsations of the pulsating jet occur at a distance of about 1.5 to 3 transverse dimensions of the jet from the surface of the blank.

18. The method of claim 3, wherein the pulsating jet has density pulsating in the range of 0.1 to 1.3 relative to the theoretical density of the working medium material of the pulsating jet.

19. The method of claim 6, wherein the pulsations of the pulsating jet occur at a distance of about 1.5 to 3 transverse dimensions of the jet from the surface of the blank.

20. The method of claim 10, wherein the pulsating jet has density pulsating in the range of 0.1 to 1.3 relative to the theoretical density of the working medium material of the pulsating jet.

21. The method of claim 18, wherein the pulsations of the pulsating jet occur at a distance of about 1.5 to 3 transverse dimensions of the jet from the surface of the blank.

22. The method of claim 18, wherein the elongated alloyed zones occupy less than 1 vol. %, and restructured zones occupy less than 10 vol. % of the high speed steel and wherein the pulsations of the pulsating jet occur at a distance of about 1.5 to 3 transverse dimensions of the jet from the surface of the blank.

23. The method of claim 3, wherein the working medium mixture comprises: 40 to 60 vol. % of a silicon carbide fraction having dimensions of 3 to 250 μm; 40 to 50 vol. % of a nickel fraction having dimensions of 1 to 100 μm; and the balance of aluminum oxide and fraction having dimensions of 20 to 50 μm.

24. The method of claim 6, wherein the working medium mixture comprises: 40 to 60 vol. % of a silicon carbide fraction having dimensions of 3 to 250 μm; 40 to 50 vol. % of a nickel fraction having dimensions of 1 to 100 μm; and the balance of aluminum oxide and fraction having dimensions of 20 to 50 μm.

25. The method of claim 20, wherein the working medium mixture comprises: 40 to 60 vol. % of a silicon carbide fraction having dimensions of 3 to 250 μm; 40 to 50 vol. % of a nickel fraction having dimensions of 1 to 100 μm; and the balance of aluminum oxide and fraction having dimensions of 20 to 50 μm.

26. The method of claim 3, wherein the working medium mixture comprises: 20 to 80 vol. % of titanium carbonitride fraction having dimensions in the range of 1 to 100 μm; 20 to 60 vol. % of a nickel powder fraction having dimensions of 1 to 100 μm; and the balance of a silicon nitride powder fraction having dimensions of 1 to 60 μm.

27. The method of claim 6, wherein the working medium mixture comprises: 20 to 80 vol. % of titanium carbonitride fraction having dimensions in the range of 1 to 100 μm; 20 to 60 vol. % of a nickel powder fraction having dimensions of 1 to 100 μm; and the balance of a silicon nitride powder fraction having dimensions of 1 to 60 μm.

28. The method of claim 20, wherein the working medium mixture comprises: 20 to 80 vol. % of titanium carbonitride fraction having dimensions in the range of 1 to 100 μm; 20 to 60 vol. % of a nickel powder fraction having dimensions of 1 to 100 μm; and the balance of a silicon nitride powder fraction having dimensions of 1 to 60 μm.

* * * * *